US005644818A

United States Patent [19]

Price et al.

[11] Patent Number: 5,644,818

[45] Date of Patent: Jul. 8, 1997

[54] FABRIC DISTRIBUTOR

[75] Inventors: Ellie E. Price, Charlotte; William C. Hardin, Jr., Lexington, both of N.C.

[73] Assignee: Tubular Textile LLC, Lexington, N.C.

[21] Appl. No.: 713,690

[22] Filed: Sep. 17, 1996

Related U.S. Application Data

[63] Provisional application No. 60/004,378, Sep. 27, 1995.

[51] Int. Cl.[6] ..... D04H 11/00; B21C 47/10

[52] U.S. Cl. ..... 19/159 R; 28/289; 53/116; 68/177; 242/361.4

[58] Field of Search ..... 100/40, 76, 80, 100/81; 19/159 R; 28/289, 290; 53/116, 430; 68/177, 178; 242/361, 361.4; 414/300, 301

[56] References Cited

U.S. PATENT DOCUMENTS

| | | | |
|---|---|---|---|
| 1,232,017 | 7/1917 | French, Jr. . | |
| 1,321,834 | 11/1919 | Lyth . | |
| 1,328,615 | 1/1920 | Carter et al. . | |
| 1,342,190 | 6/1920 | Taylor et al. . | |
| 1,475,428 | 11/1923 | Carter | 19/159 R |
| 1,528,065 | 3/1925 | Lyth . | |
| 1,531,788 | 3/1925 | Jefferson . | |
| 1,710,544 | 4/1929 | Lyth | 68/177 |
| 2,971,683 | 2/1961 | Paulsen | 19/159 R |
| 3,120,931 | 2/1964 | Lorenz | 242/361.4 |
| 4,654,910 | 4/1987 | Kusuki et al. . | |

*Primary Examiner*—Stephen F. Gerrity
*Attorney, Agent, or Firm*—Schweitzer Cornman Gross & Bondell LLP

[57] ABSTRACT

A distributing mechanism for depositing wet processed fabric in rope-form in a container. A tubular distributing guide is mounted for pivoting movement on a distributing ring rotatable about a vertical axis. Ribbed support rollers on the distributing ring are received in annular grooves in a concentric support ring, such that the distributing ring is mounted by the support ring, but is rotatable with respect thereto. The support ring itself is supported for rotation about a vertical axis. Both rings are driven by a common external drive motor, but at slightly different rotational speeds. A circular cam track, formed in the supporting ring, cooperates with a cam follower wheel carried by the distributing guide. As the distributing and supporting rings are rotated, the relative motion therebetween results in the follower wheel moving along the cam track, varying the angle at which the distributing guide is disposed, whereby fabric is deposited in neat, uniform layers within the container, for relatively easy and tension-free removal at a later time for subsequent processing.

11 Claims, 4 Drawing Sheets

FABRIC DISTRIBUTOR

This application claims priority of provisional application Ser. No. 60/004,378, filed Sep. 27, 1995.

BACKGROUND AND SUMMARY OF THE INVENTION

The present invention is directed to an apparatus for the loading of wet, rope-form fabric, typically not necessarily tubular knitted fabric, into a container in a uniform, evenly distributed manner to facilitate the subsequent extraction of the fabric from such container.

In the dyeing of tubular knitted fabric, for example, an elongated length of such fabric is placed in a closed vessel for processing, typically under pressure. At the end of the operation, the wet fabric is withdrawn from the dye vessel or jet and deposited in a container, from which it is later removed for further processing, often at another location within the plant. In many such processing operations as presently practiced, the wet fabric is withdrawn from the dye jet or other vessel by a lifting roller or the like and simply deposited by gravity in an accumulating pile in the receiving container. In such a procedure, the rope-form fabric tends to build up in a somewhat conical pile in the container, and from time to time the pile topples to one side or another so that, as the container is filled, the entire cross section of the container is occupied by the deposited fabric. Such a procedure results in significant problems at the next stage, however, when the fabric is withdrawn from the container. These result from the fact that the periodic random toppling of the fabric piles can result in tangles, and frequently requires that fabric be forcibly pulled out from under overlying layers of later-deposited fabric.

There are mechanisms known to the art for distributing the deposit of fabric into a vessel, representative of which are, for example, mechanisms shown in the Carter et al. U.S. Pat. No. 1,328,615, the Taylor U.S. Pat. No. 1,342,190 and the Jefferson U.S. Pat. No. 1,531,788. While such apparatuses presumably are functional, they have not been widely adopted in the trade, possibly because of complexity, and therefore cost, or lack of reliability, or a combination of these and other factors.

In accordance with the present invention, a novel and improved mechanism is provided for effecting a desirably distributed deposit of wet fabric into a receiving container, in such manner that the fabric is evenly distributed in layers over the cross section of the container, and thus enabling the fabric to be subsequently withdrawn from the container free of tangles, knots, excessive resistance or the like. The apparatus of the invention is of a highly simplified and economical design, rendering economically attractive and beneficial for widespread installation and use, yet is durable and entirely reliable in operation.

In accordance with the invention, a distributing guide, preferably in the form of a tube, is positioned to receive fabric at its upper end and to discharge it by gravity from its lower end. The guide is mounted for pivoting movement on a ring-like rotary support. The rotary support is in turn rotatably mounted by a concentrically positioned support ring, which in itself is rotatably mounted in a stationary frame.

In a preferred and advantageous form of the invention, the concentric support ring is configured about its peripheral area with a cam surface, cooperating with the pivotally mounted distributing guide. The arrangement is such that, as the distributing guide is rotated relative to the support ring, the coaction between the distributing guide and the cam profile controls the angular orientation of the distributing guide such that fabric is distributed in a desired manner over the entire surface of the container below. In the mechanism of the invention, the support ring itself is rotatably mounted and is driven to rotate at a different speed than the speed of rotation of the distributing guide. Accordingly, a complete cycle of angular motion of the distributing guide, under the control of the distributing cam, requires several revolutions of the distributing guide.

Although the operations of the new mechanism are functionally ideal for the purposes intended, the mechanisms involved are simple, reliable and capable of economical manufacture.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
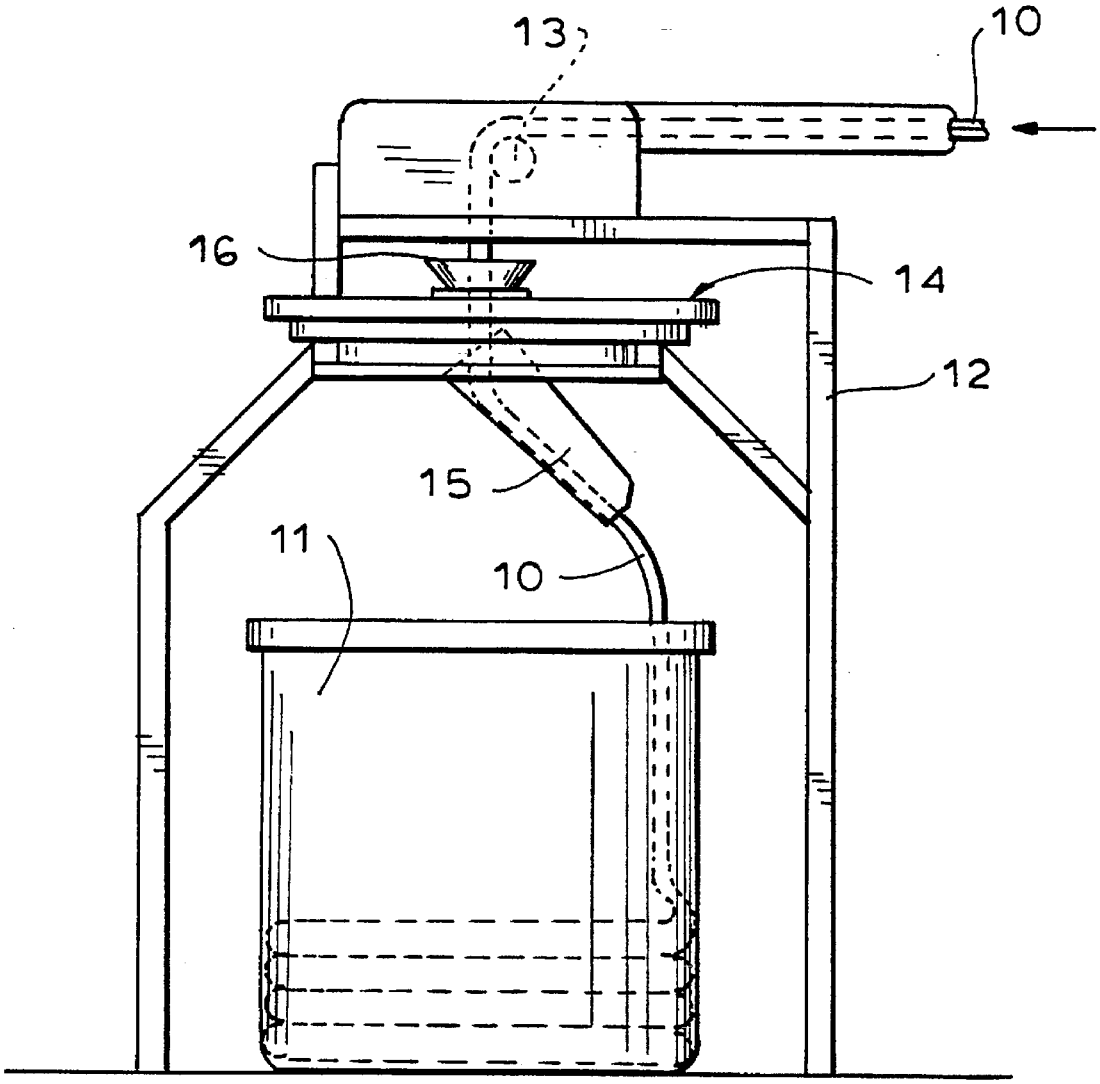
FIG. 1 is a simplified generally schematic illustration of an apparatus according to the invention illustrated as loading fabric into a container in a distributed manner.

Referring now to the drawing, the reference numeral 10 designates fabric being transferred from a dye jet or the like (not shown) for deposit into a container 11. The container is straddle by a frame structure 12, which includes a controllably driven transfer roller 13 and a fabric distributing mechanism, generally designated by the reference numeral 14, which serves to distribute the fabric 10 uniformly, in layers, in the container 10, during the course of the transfer of the fabric. In general, the distributing mechanism includes a distributing guide 15, advantageously in the form of a tapered tube, open at the top and bottom. The distributing guide is pivotally mounted at its upper end, in position to receive fabric directed into its upper end, by means of a receiving guide funnel 16. As will be more fully described, as fabric is drawn from the previous operation by the transfer roller 13 and directed downwardly into the upper end of the distributing guides 15, the guide is controllably rotated and, as a function of such rotation, is controllably pivoted to be oriented at various distributing angles throughout the loading process.

Figure 2:
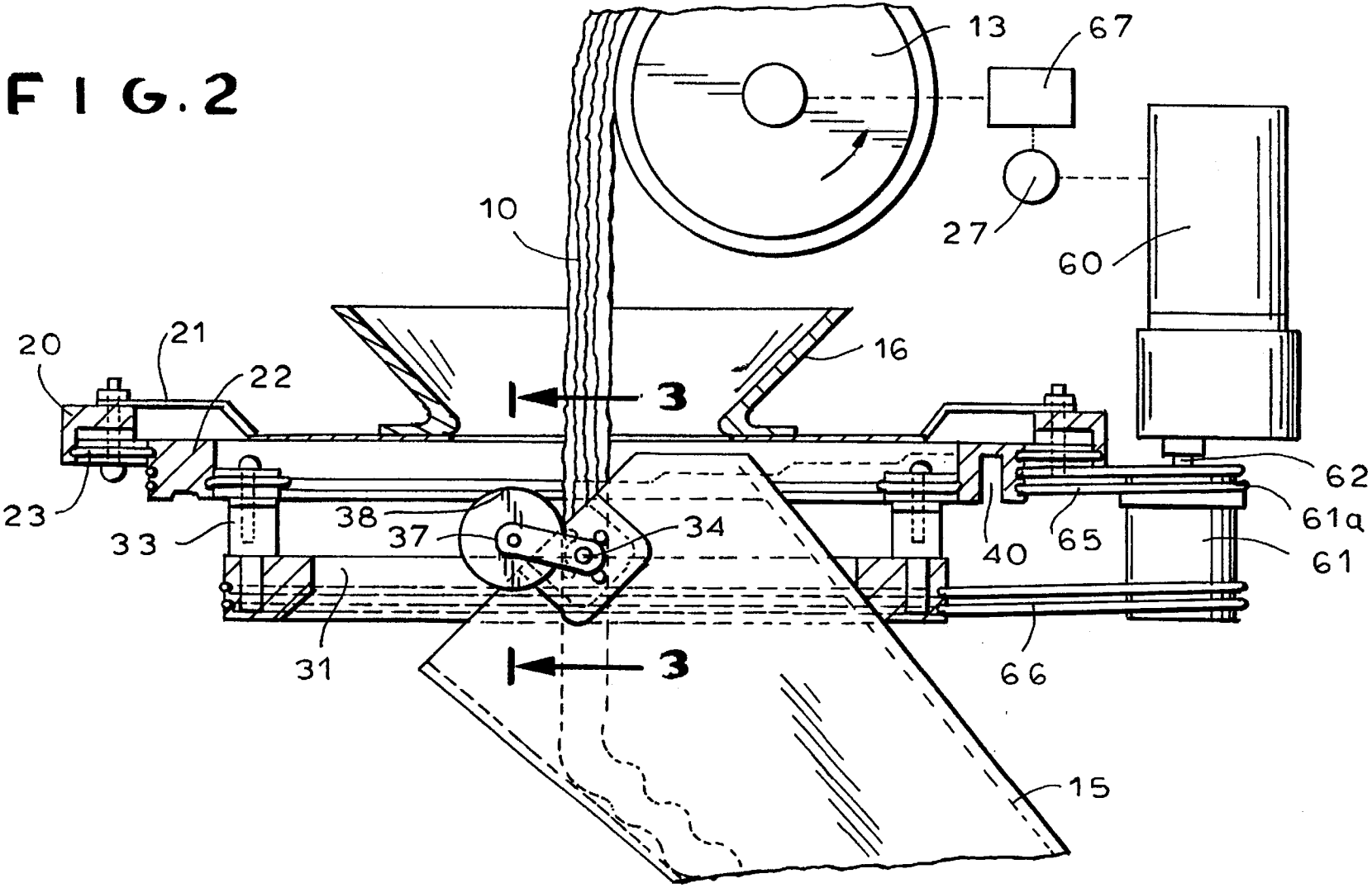
FIG. 2 is an enlarged cross sectional illustration of the mechanism of the invention.
Figure 3:
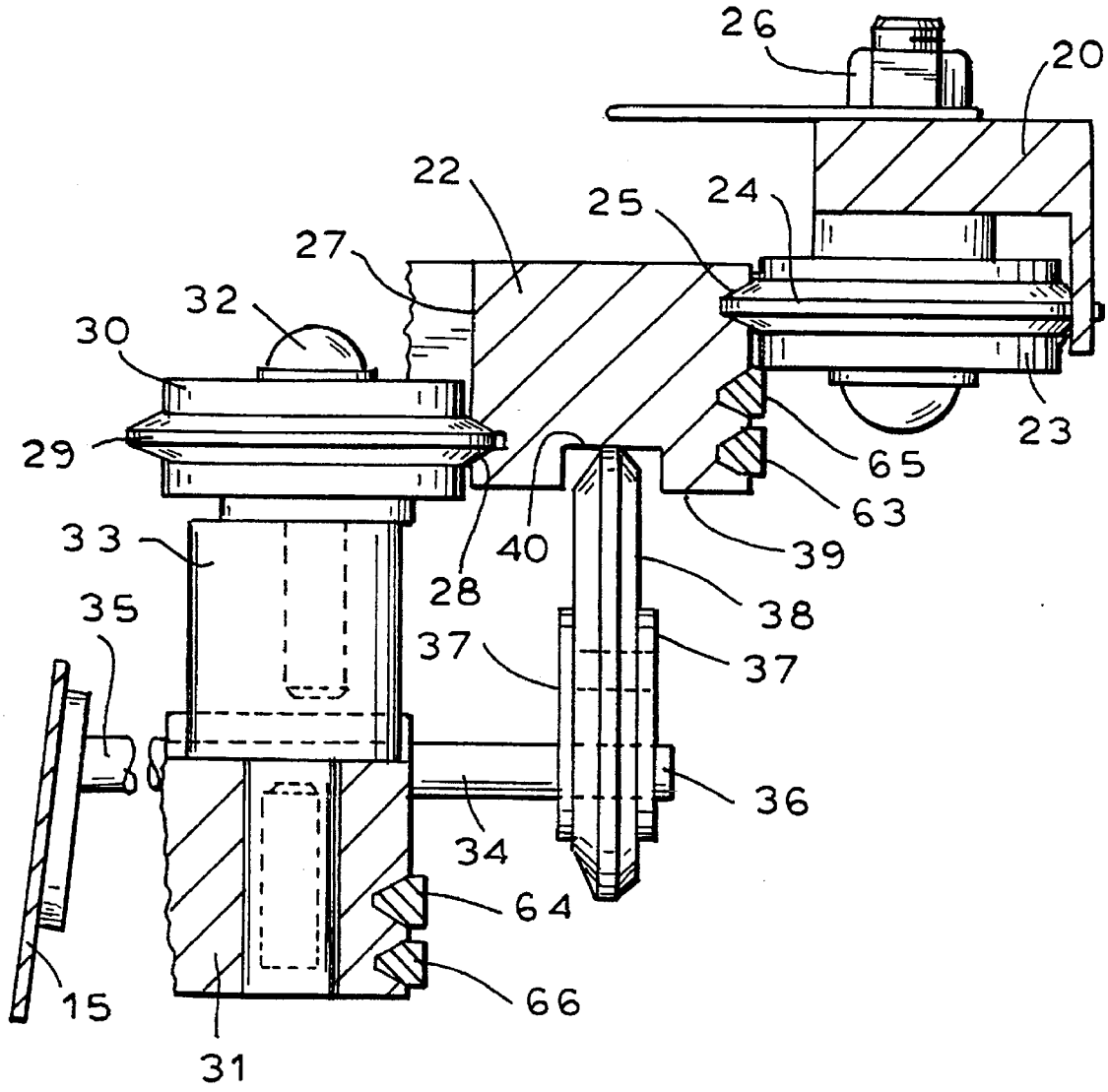
FIG. 3 is a greatly enlarged, fragmentary cross sectional view illustrating details of construction features of the invention.

With reference now more particularly to FIGS. 2 and 3, the mechanism of the invention includes a rigid open frame structure 20 to which is secured a cover element 21. The cover element is open in the center and mounts the guide funnel 16. The frame 20 is mounted in the frame structure 12 to position the funnel substantially directly below the descending "rope" of fabric passing over the transfer roller.

In the illustrated form of the invention, a support ring 22, formed of light metal or structural plastic material, is mounted for rotation in the frame 20, in generally concentric relation to the guide funnel 16. To advantage, rotational mounting of the support ring is provided by a plurality of annularly ribbed rollers 23 mounted in the frame 20 at angularly spaced locations, for example every 45° or 60°. Annular ribs 24 formed on the rollers 23 are received in outwardly facing V-shaped grooves 25 formed on the support ring. As illustrated in FIG. 3, the ribbed support rollers 23 are mounted to the circular frame 20 by means of journal bolts 26, at least some of which advantageously are provided with eccentric journal portions to accommodate limited radial adjustment of the support rollers to assure a close-fitting relation between the ribbed support rollers and the V-shaped grooves in which they are received.

In accordance with the invention, the support ring 22 is also formed on its inner surface 27 with an inwardly facing annular V-shaped groove 28. The groove 28 is arranged to receive annular ribs 29 of a plurality of angularly spaced support rollers 30, which carry a distributing member 31, preferably of ring-like form. The support rollers 30 are mounted by journal bolts 32, some or all of which preferably include eccentric portions 33 providing for minor radial adjustment of the positions of the rollers 30, to have a snug fitting relation in the groove 28. At each side, the distributing ring 31 carries a shaft 34 which is fixed at its inner end 35 to an upper portion of the distributing guide 15. The shaft 34 is rotatable relative to the distributing ring 31 and rigidly mounts at its outer end 36 support arms 37 mounting a cam follower wheel 38.

Figure 4:
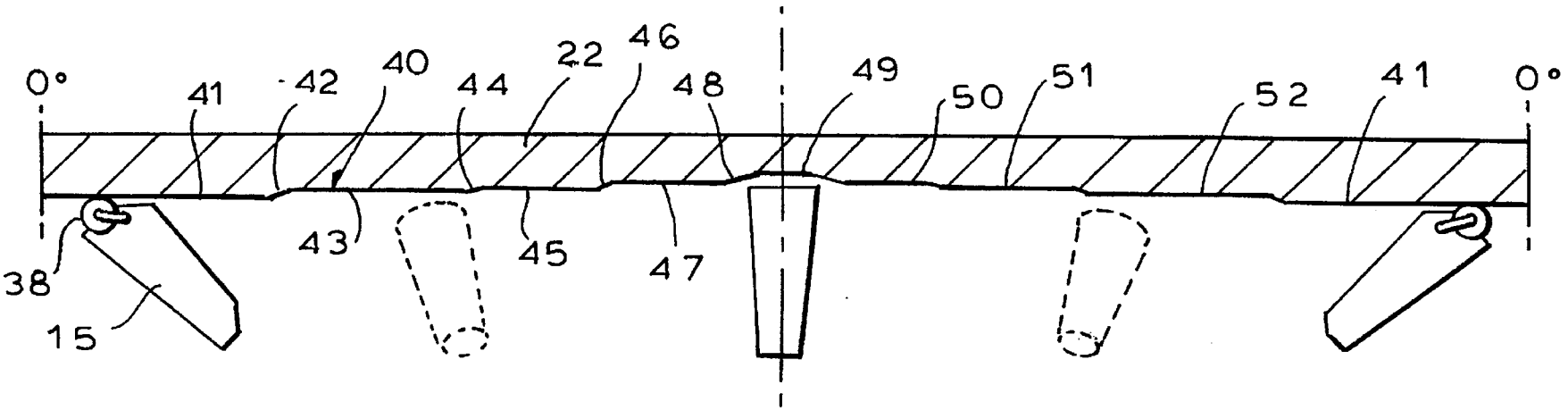
FIG. 4 is a developed, schematic illustration of the preferred cam profile employed in the mechanism of the invention.

In accordance with one aspect of the invention, the support ring 22 is formed on its downwardly facing side 39 with a contoured cam track 40 arranged to receive the cam follower wheel 38. FIG. 4 illustrates a developed view of the cam track 40, as if taken on a circular cross section line extending entirely around the circumference of the cam track. Viewed as from left to right in FIG. 4, the cam track 40 has an elongated flat or plateau portion 41, constituting the lowest portion of the cam track relative to the support ring 22. When the cam follower 38 is in contact with the track portion 41, the follower wheel and its mounting arms 37 are depressed, causing the distributing guide 15 to be pivoted upwardly to a limit position, as indicated in FIG. 2 and reflected schematically at the left in FIG. 4. As the cam follower 38 moves toward the right, relative to the cam track, as viewed in FIG. 4, it passes over a transitional portion 42 and then reaches a second flat plateau portion 43, at a slightly higher level than the plateau portion 41. When the cam follower wheel 38 contacts the surface 43, the distributing guide 15 is permitted to assume a slightly more vertical angle. In progression, as relative motion continues, the cam follower wheel encounters a transition surface 44, a further elevated plateau surface 45, a transitional surface 46 and still another plateau surface 47. Thereafter, the follower wheel encounters a transitional surface 48 and a plateau surface 49, constituting the highest elevation of the cam track. The plateau surface 49 desirably is located approximately half way around the circumference of the cam track, as is reflected by the 180° notation in FIG. 4. When the cam follower 38 engages the uppermost plateau level 49, the distributing guide is in a near-vertical position.

During the second half of travel of the follower wheel 38 along the cam track 40, the follower wheel encounters a mirror image of the first half of the track, with the track progressively stepping down through transition surfaces to successively lower plateau surfaces 50–52, until the follower wheel eventually returns to the initial plateau surface 41, at which the distributing guide is again disposed at a maximum angle to the vertical.

As reflected in FIG. 4, as the plateau surfaces become successively more elevated, allowing the distribution guide to assume progressively more vertical angles, the length of the plateau surface becomes progressively shorter. In this respect, a sweep of the distributing guide 15 about the outer circumference of the container 11, that is, when the distribution guide 15 is in a position of maximum angularity, a single revolution of the distributing guide, which occurs in a fixed period of time, distributes the fabric along a circular path of substantial circumference. As the angularity of the distributing guide becomes progressively more vertical, the circumference of the distribution path, is progressively less. However, the length of fabric deposited in a single revolution remains the same. This is compensated for by providing progressively less dwell time of the distributing guide 15 in the more vertical positions. Although the illustrated cam track 40 is comprised of a series of plateaus and connecting transition surfaces, the track may also take the form of a continuous incline with portions of varying rise over its length.

In a preferred form of the invention, both the support ring 22 and the distribution ring 31 are driven by a common motor 60 mounting a multiple groove drive pulley 61 on its output shaft 62. In the illustrated form of the invention, each of the rings 22, 31 is provided with a pair of outwardly facing grooves 63, 64 receiving dual drive belts 65, 66, which are trained about the drive pulley 61. Thus, when the drive motor 60 is in operation, both of the rings 22 and 31 are driven thereby. In the illustrated embodiment, the upper portion **61*a*** of the drive pulley is slightly larger than the lower portion.

Pursuant to an aspect of the invention, the distribution ring 31 is somewhat smaller in diameter than the support ring 22, so as to rotate at a somewhat higher speed. By way of example, the relative diameters of the respective rings at the drive belt grooves may be such that the distribution ring 31 is driven at a rate of, for example, five revolutions for each four revolutions of the supporting ring 22. Accordingly, a complete cycle of the cam follower 38 over the cam surface 40 will require approximately five revolutions of the distributing rings 31. One advantageous result of this arrangement is that the deposit pattern will repeat only after long intervals of time.

Desirably, a drive motor 67, provided for the operating transfer roller 13, and the drive motor 60 for the distributing mechanism, are so controlled, as by a control device 68, that the rate of infeed of the fabric 10 over the transfer roller is at least as great as the rate of travel of the outer end of the distributing guide 15, when the guide is at its most angular position. When the distributing guide is in a more vertical position, the fabric will be deposited at a greater lineal rate than the rate of circumferential travel of the guide 15, so that the fabric gathers slightly as it is deposited toward the center portions of the container. Excess fabric is not allowed to accumulate at any location, however, because of the shorter dwell time of the cam follower as the distributing guide assumes progressively more vertical positions.

While it is understood that the principles of the invention are applicable to equipment of any size, a typical, commercially useful apparatus, may have a distributing guide 15 arranged to have a maximum angularity of approximately 40° from the vertical. In that position the typical guide can deposit fabric to a diameter of up to about 48 inches. As shown in FIG. 2, an upper corner portion of the tubular distributing guide 15 is cut away at **15*a* to accommodate the free downward flow of fabric when the guide 15** is in a position of maximum angularity. Such a typical apparatus can easily deposit fabric at a rate of 120 lineal yards per minute or more.

The mechanism of the invention is uniquely desirable for its intended usage. It is simple and economical to manufacture and install. All rotating and movable components are driven by a single motor to operate a cam follower and cam track at predetermined differential speeds to provide a neat, uniformly layered deposit of fabric in a container. The mechanism provides a highly useful, low cost alternative to equipment presently available for the purpose.

The illustrated construction of the invention is particularly advantageous in that a support ring, utilized for rotatably supporting a distribution element, is in itself rotated with a differential speed, providing an advantageous arrangement for cam and cam follower to achieve a desire deposit pattern of fabric in the container.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A system for feeding and distributing rope-form fabric into an open-top container with a layered distribution, and comprising an elongated distributing guide for receiving fabric from a source and having a discharge end for controllably discharging said fabric into said container, first means for supporting said distributing guide for rotation above said container, second means for controllably manipulating the discharge end of said distributing guide between a first position, near center portions of said container and a second position near outer portions of said container, characterized by (a) a distributing member mounted for rotation about a vertical axis, (b) pivot means on said distributing member for pivotally supporting upper end portions of said distributing guide for swinging movement in a direction radially of said vertical axis between first and second limit positions in which the discharge end of said distributing guide is positioned, respectively, near center portions of said container and near outer portions of said container, (c) a ring-like member coaxial with said distributing member, (d) said ring-like member having a circular cam track thereon formed with progressively rising portions over a first portion of its length and progressively declining portions over a second portion of its length, (e) cam follower means associated with said distributing guide and engaging said circular cam track, whereby relative rotational movement of said ring-like member and said distributing member results in swinging movement of said distributing guide between said first and second limit positions, and (f) drive means for rotating said ring-like member and said distributing member simultaneously but at slightly different speeds, whereby to cause relative movement between said cam follower and said cam track.

2. A feeding and distributing system according to claim 1, wherein (a) said drive means operates to cause said ring-like member to rotate at a slightly faster rate than said distributing member, whereby several complete revolutions of said distributing member are required to enable said cam follower to travel over the full length of said cam track.

3. A feeding and distributing system according to claim 1, wherein (a) said distributing member is mounted for rotation by said ring-like member.

4. A feeding and distributing system according to claim 3, further including (a) a frame, (b) a first plurality of roller elements on one of said frame or ring-like member for supporting said ring-like member for rotation, and (c) a second plurality of roller elements on one of said ring-like member or distributing member for supporting said distributing member for rotation relative to said ring-like member.

5. A feeding and distributing system according to claim 1, wherein (a) said distributing member is mounted below said ring-like member, (b) a drive motor is mounted laterally of said distributing and ring-like members, and (c) first and second sets of drive belts connect said drive motor to said distributing member and to said ring-like member.

6. A feeding and distributing system according to claim 5, wherein (a) said distributing member is of circular external configuration, and (b) said ring-like member is of larger diameter than said distributing member.

7. A feeding and distributing system according to claim 1, wherein (a) said cam track comprises a downwardly opening circular groove in said ring member, and (b) said cam follower comprises a wheel, carried in fixed relation to said distributing guide and received in said circular groove.

8. A feeding and distributing system according to claim 1, wherein (a) said cam track is contoured with a plurality of steps of progressively changing levels for orienting said distributing guide is progressively changing angles, and (b) those steps of said cam track which orient said distributing guide at relatively more vertical angles are of relatively shorter length, whereby the dwell time of said distributing guide at relatively more vertical angles is less than at relatively less vertical angles.

9. A feeding and distributing system according to claim 1, wherein (a) said distributing member and said ring-like member are concentric ring elements, (b) said distributing member is mounted directly below said ring like member in concentric relation, (c) said distributing guide is pivoted at an upper end portion thereof by shaft means supported on said distributing member, whereby the upper end portion of said distributing guide is supported within a center opening defined by said distributing member.

10. A feeding and distributing system according to claim 9, wherein (a) an upwardly divergent guide funnel is mounted on said frame, directly above the upper end of said distributing guide.

11. A feeding and distributing system according to claim 10, wherein (a) said distributing guide is a tubular member, and (b) an upper corner portion of said tubular member is cut away to accommodate the free flow of fabric thereinto from said guide funnel when said distributing guide is oriented in a position of maximum angularity with respect to the vertical.

* * * * *